US005558554A

United States Patent [19]

Finklea et al.

[11] Patent Number: 5,558,554

[45] Date of Patent: Sep. 24, 1996

[54] METHOD FOR FABRICATING A FIELD EMISSION DEVICE ANODE PLATE HAVING MULTIPLE GROOVES BETWEEN ANODE CONDUCTORS

[75] Inventors: John E. Finklea, Garland; Chi-Cheong Shen, Richardson; Kenneth G. Vickers, Whitesboro; Mark A. Kressley, Richardson, all of Tex.

[73] Assignee: Texas Instruments Inc., Dallas, Tex.

[21] Appl. No.: 455,312

[22] Filed: May 31, 1995

[51] Int. Cl.[6] ..... H01J 9/20

[52] U.S. Cl. ..... 445/52; 445/24; 313/495; 313/496

[58] Field of Search ..... 445/24, 35, 49, 445/52; 313/495, 496, 461

[56] References Cited

U.S. PATENT DOCUMENTS

| | | | |
|---|---|---|---|
| 3,755,704 | 8/1973 | Spindt et al. | 313/309 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,491,376 | 2/1996 | Levine et al. | 313/495 |
| 5,508,584 | 4/1996 | Tsai et al. | 445/24 |

FOREIGN PATENT DOCUMENTS

| | | | |
|---|---|---|---|
| 4-245152A | 9/1992 | Japan | 313/461 |

OTHER PUBLICATIONS

IEEE *Transactions on Electrical Insulation*, Sudarshan, T. S., Cross, J. D., Srivastava, K. D., "Prebreakdown Processes Associated With Surface Flashover of Solid Insulators in Vacuum," pp. 200–208, vol. EI–12, No. 3, Jun. 1977.

IEEE *Transactions of Electrical Insulation*, Tourreil, C. H., Srivastava, K. D., "Mechanism of Surface Charging of High–Voltage Insulators in Vacuum," pp. 17–21, vol. EI–8, No. 1, Mar. 1973.

*Primary Examiner*—Kenneth J. Ramsey
*Assistant Examiner*—Jeffrey T. Knapp
*Attorney, Agent, or Firm*—Rose Alyssa Keagy; Richard L. Donaldson

[57] ABSTRACT

A method of fabricating an anode plate 40 having a multiplicity of grooves 50 for use in a field emission flat panel display device comprises the steps of providing a transparent planar substrate 42 having a plurality of electrically conductive, parallel stripes 46 comprising the anode electrode of the device; etching a plurality of grooves 50 in the surface of the substrate in the spaces between the stripes 46; and then applying phosphor material $\mathbf{48}_R$, $\mathbf{48}_G$ and $\mathbf{48}_B$ over the stripes 46. In one embodiment, a plurality of grooves 50', having generally vertical sidewalls, are formed in the upper surface of planar substrate 42' at the interstices of conductors 46. In a second embodiment, a plurality of grooves 50", having generally curved sidewalls, are formed in the upper surface of planar substrate 42' at the interstices of conductors 46'. In a third embodiment, a plurality of grooves 50", having generally vertical sidewalls, are formed in the upper surface of an insulating material 52 located between conductors 46". In a fourth embodiment, a plurality of grooves 50'", having generally curved sidewalls, are formed in the upper surface of an insulating material 52' between conductors 46'". In a fifth embodiment, a plurality of grooves are formed in the upper surface of planar substrate 100, and insulating material 108 is applied over the grooves. In a sixth embodiment, a plurality of grooves are formed in both the surface of the planar substrate 120 and the surface of insulating material 128.

30 Claims, 6 Drawing Sheets

METHOD FOR FABRICATING A FIELD EMISSION DEVICE ANODE PLATE HAVING MULTIPLE GROOVES BETWEEN ANODE CONDUCTORS

RELATED APPLICATION

This application includes subject matter which is related to U.S. patent application Ser. No. 08/456,259, "Achieving High Voltage Standoff Through Increasing The Path Length Between Anode Conductors," (Texas Instruments), filed even date. This application also includes subject matter which is related to U.S. patent application Ser. No. 08/253,476, "Flat Panel Display Anode Plate Having Isolation Grooves," (Texas Instruments), filed Apr. 3, 1994, now U.S. Pat. No. 5,491,376. Furthermore, this application includes subject matter which is related to U.S. patent application Ser. No. 08/445,614, "Method For Achieving Anode Stripe Delineation From An Interlevel Dielectric Etch In A Field Emission Device," (Texas Instruments), filed May 22, 1995.

TECHNICAL FIELD OF THE INVENTION

The present invention relates generally to flat panel displays and, more particularly, to a method for fabricating an anode plate for use in a flat panel display having multiple grooves formed in the substrate and/or the insulation in the spaces between the anode conductors.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for lap top and notebook computers. In comparison to a CRT, these displays have limited brightness, only a limited range of viewing angles, and, in color versions, they consume power at rates which are incompatible with extended battery operation. In addition, color liquid crystal display screens tend to be far more costly than CRT's which have an equal screen size.

As a result of the drawbacks of liquid crystal display technology, field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays is promising.

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robed Meyer; and U.S. Pat. No. 5,225,820, "Microtip Trichromatic Fluorescent Screen," issued Jul. 6, 1993, to Jean-Frêdêric Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anode stripes.

A shortcoming of field emission displays of the current technology is the low emission intensity of the low voltage phosphors typically used as the luminescent material on the display screen. The low emission intensity of the phosphor has several origins, one of which is the low acceleration voltage used to excite the free electrons toward the anode. Currently, this acceleration voltage is limited by the potential which can be placed between adjacent transparent stripe anode conductors underlaying the phosphor stripes, typically about 300–500 volts. It is known that significantly improved performance and image brightness would be provided by increasing the anode potential to about 1000 volts. However, as the acceleration voltage is increased, the leakage current between the conductive anode stripes increases, and it is possible that high voltage breakdown can occur.

When a high voltage breakdown occurs, there is arcing between anode stripes as current flows across the anode surface from the anode stripe which is at a high potential to an adjacent anode stripe which is at a low potential. The arcing may also occur through the vacuum space between the anode stripes; however, at the vacuum levels commonly used in the FED it is unlikely that the breakdown would occur through the vacuum before occurring across the anode surface. During the high voltage breakdown, the user may see a dimming of the display image where the current is leaving the high potential anode stripe. In addition, the user may simultaneously see a color bleed as an anode stripe which was at low potential receives current, and as a result, the phosphors at that location luminesce.

Factors contributing to the breakdown voltage between adjacent anode stripes include anode stripe geometry, surface conditions, the applied electric field, and transport time. The anode stripe geometry affects the breakdown voltage level because any sharp edges located on the anode stripe create an enhanced electric field during display operation and therefore lowers the voltage level at which breakdown will occur. The surface condition of the anode plate between the anode stripes affects the breakdown voltage level because contaminants present on the surface may encourage the flow of electrons between the anode stripes. In addition, the material composition of the surface affects the breakdown voltage level due to the inherent properties of water absorption, outgasing, and charge properties. The applied electric field affects the breakdown voltage because the leakage current is directly proportional to the potential applied to the anode stripe. Also, the higher the potential on the anode stripe the higher the chances are for a voltage breakdown below operating voltage. Transport time is the time it takes for the electrons to travel along the surface between the anode stripes. Therefore, if the anode stripe is not charged for a time long enough for the current to flow between anode stripes a high voltage breakdown will not occur. The mechanisms which affect high voltage breakdown are discussed in more detail in IEEE Trans. Electr. Insul., Sudarshan, T. S., Cross, J. D., Srivastava, K. D., "Prebreakdown Processes Associated With Surface Flashover of Solid Insulators in Vacuum," pp. 200–208, Vol. E1–12, No. 3 June, 1977, and IEEE Trans. Electr. Insul., Tourreil, C. H., Srivastava, K. D., "Mechanism of Surface Charging of High-Voltage Insulators in Vacuum," pp.17–21, Vol. E1–8, No. 1, March 1973, both incorporated herein by reference.

Increasing the anode potential to increase luminance has many benefits. For example, increasing the luminance permits the display image to be clearly visible in environments of bright ambient light, such as outdoor sunlight. An increased display luminance also accommodates FED overhead projector applications. As described above, increasing the anode potential to realize these benefits increases the likelihood of a high voltage breakdown. Therefore, the anode stripes may need to be spaced farther apart in high voltage applications to protect the apparatus against the occurrence of a high voltage breakdown.

Unfortunately, spacing the anode stripe conductors further apart to accommodate the high luminance applications decreases the image resolution. Decreasing the image resolution makes the display image less defined and therefore, the product will be less desirable to the user. Furthermore, future applications will demand higher resolutions and therefore closer spacing of the anode stripes. For example, while the most common resolution used today is a VGA standard of 640 pixels by 480 pixels for a 10" diagonal display, some applications exist which require the SVGA standard of 800 pixels by 600 pixels, or even require the XGA standard of 1240 pixels by 1080 pixels for the same display size.

In view of the above, it is clear that there exists a need for an improved method of fabricating the anode plate of a field emission flat panel display device such that the anode plate facilitates an increased acceleration voltage to thereby provide higher luminance and greater display image resolution.

SUMMARY OF THE INVENTION

In accordance with the principles of the present invention, there is disclosed herein a method of fabricating an anode plate for use in a field emission device. The method comprises the steps of providing a transparent substrate having spaced-apart, electrically conductive regions on a surface thereof, etching a plurality of grooves in the surface in the spaces between said electrically conductive regions, and applying luminescent material on the conductive regions.

In a preferred embodiment an electrically insulating material is deposited on the substrate between the conductors and a plurality of grooves is etched in a surface of the insulating material. Alternatively, the anode plate is fabricated with a plurality of grooves formed both on the surface in the spaces between the conductive regions and on electrically insulating material deposited between the conductors.

A field emission flat panel display device, as disclosed herein, having an anode plate which includes a plurality of grooves in the substrate and/or insulator in the spaces between the conductive regions, and the methods disclosed herein for fabricating such anode plate, overcome limitations and disadvantages of the prior art display devices and methods. Specifically, the multiplicity of grooves, which are formed between adjacent stripe conductors, enhance the electrical isolation between the adjacent conductors by increasing the path length. This increase in the electrical isolation of the stripe conductors from one another allows higher anode potentials to be used during anode operation without the risk of panel failure from high voltage breakdown. The result of the teachings of the present invention is that the FED can operate reliably at an increased anode voltage level and therefore operate successfully at an increased luminance.

Finally, it is noted that the improved breakdown qualities of the anode plate of the present invention will allow the use of narrower spacings between high potential stripe conductors of the anode, thereby allowing increased image resolution. Hence, for flat panel display device applications, the approaches in accordance with the present invention can provide significant advantages.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
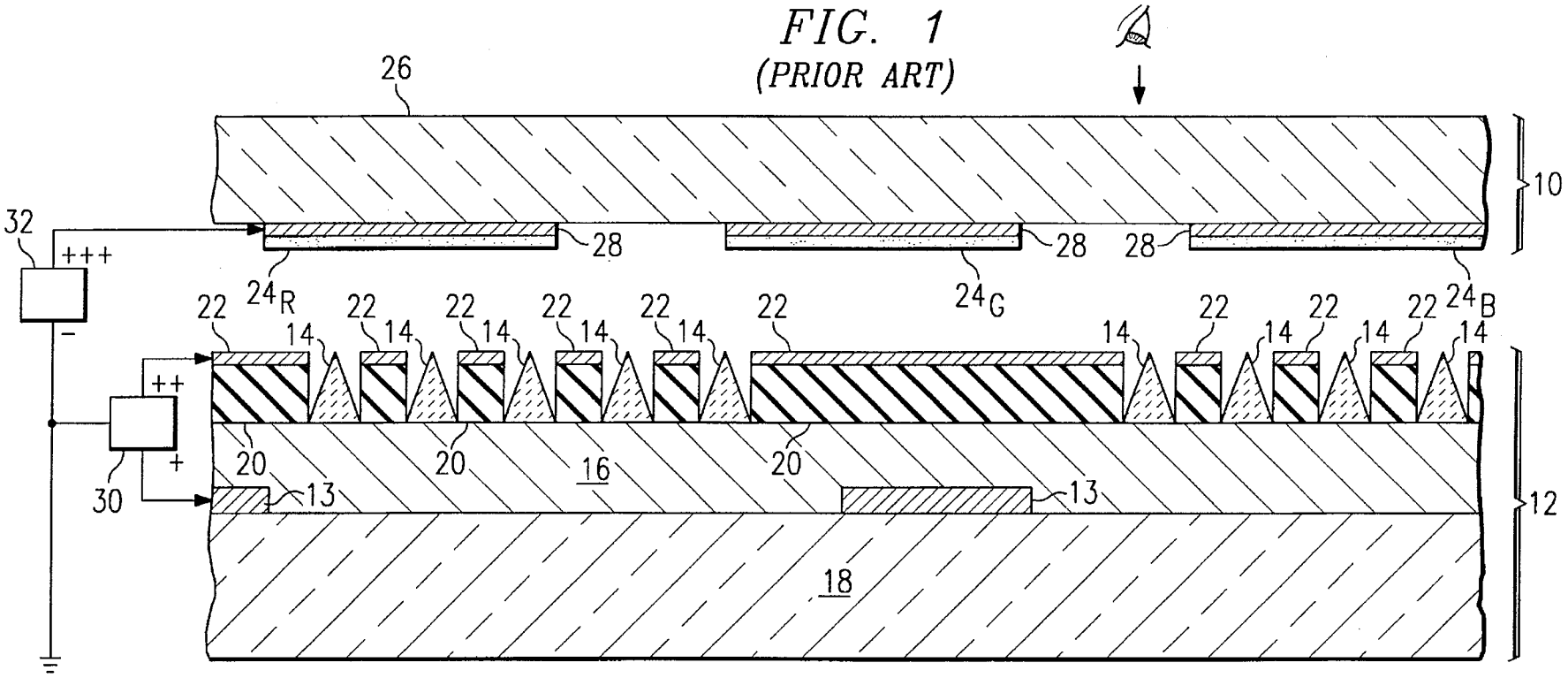
FIG. 1 (PRIOR ART)
FIG. 1 illustrates in cross section a portion of a field emission flat panel display device according to the prior art.

Referring initially to FIG. 1, there is shown, in cross-sectional view, a portion of an illustrative, prior art field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. (No true scaling information is intended to be conveyed by the relative sizes and positioning of the elements of anode plate 10 and the elements of emitter plate 12 as depicted in FIG. 1.) The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a layer of an electrically conductive material 22 which is deposited on an insulating layer 20 which overlays resistive layer 16. Microtip emitters 14 are in the shape of cones which are formed within apertures through conductive layer 22 and insulating layer 20. The thicknesses of gate electrode layer 22 and insulating layer 20 are chosen in conjunction with the size of the apertures therethrough so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material 28, also referred to as anode stripes herein, deposited on a transparent planar support 26, which is positioned facing gate electrode 22 and parallel thereto, the conductive material 28 being deposited on the surface of support 26 directly facing gate electrode 22. In this example, the regions of conductive material 28, which comprise the anode electrode, are in the form of electrically isolated stripes comprising three series of parallel conductive bands across the surface of support 26, as taught in the Clerc ('820) patent. The transparent planar support 26 is illustratively glass, and conductive material 28 is illustratively Indium-Tin-Oxide (ITO). Anode plate 10 also comprises red, green, and blue cathodoluminescent phosphor coatings $\mathbf{24}_R$, $\mathbf{24}_G$, and $\mathbf{24}_B$ respectively, deposited over conductive regions 28 so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive regions 28 functioning as the anode stripe electrode. At any given time, voltage is applied to one anode stripe electrode 28 and not to the two adjacent anode strip electrodes 28 on either side of the charged conductive region 28. Energy from the electrons attracted to the anode conductors 28 is transferred to the phosphor coating 24, resulting in luminescence. During operation, the FED display selects color by applying the required voltage to the proper anode stripe electrodes 28 in order to attract electrons emitted from the cathode structure to all red, green, or blue phosphor coatings $\mathbf{24}_R$, $\mathbf{24}_G$, and $\mathbf{24}_B$. The electron charge is transferred from the phosphor coating 24 to the conductive regions 28, completing the electrical circuit to voltage supply 32.

Figure 2:
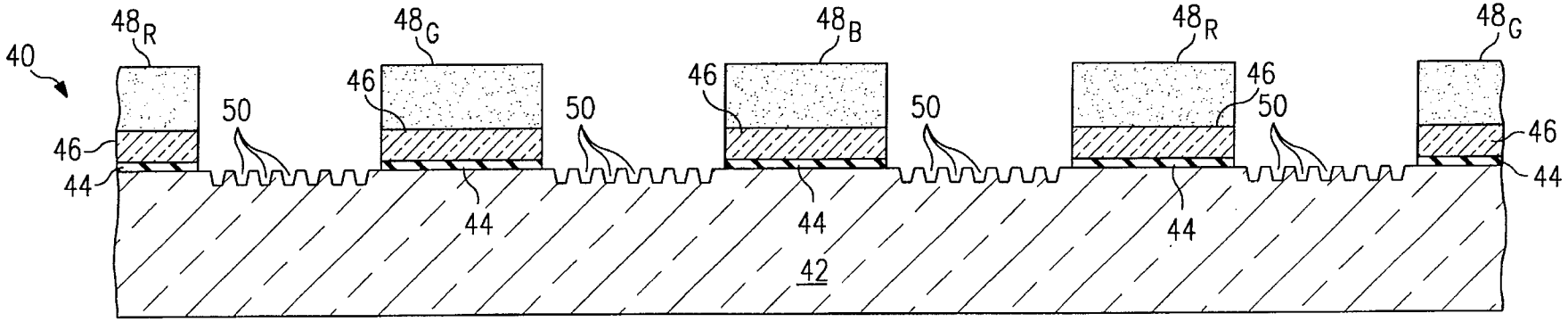
FIG. 2 is a cross-sectional view of an anode plate having isolation grooves in accordance with a first embodiment of the present invention.

Referring now to FIG. 2, there is shown a cross-sectional view of an anode plate 40 for use in a field emission flat panel display device in accordance with a first embodiment of the present invention. Anode plate 40, shown inverted from the position of anode plate 10 of FIG. 1, comprises a transparent planar substrate 42, illustratively glass, having a layer 44 of an insulating material, illustratively silicon dioxide ($SiO_2$). A plurality of electrically conductive regions 46, referred to as anode stripes, are patterned on insulating layer 44. Conductive regions 46 collectively comprise the anode electrode of the field emission flat panel display device of the present invention. Luminescent material $\mathbf{48}_R$, $\mathbf{48}_G$ and $\mathbf{48}_B$, referred to collectively as luminescent material 48, overlays anode stripe conductors 46. Grooves 50, having substantially vertical sidewalls, are formed in the upper surface of planar substrate 42 at the spaces between the anode stripe conductors 46.

A plurality of grooves 50, which are formed in the upper surface of substrate 42, enhance the electrical isolation between adjacent anode stripes 46 by increasing the path length between the anode stripes 46. Increasing the path length separates the high voltage fields which may surround the anode stripes 46; thereby increasing the voltage at which a high voltage breakdown will occur. Illustratively, there are nine one micron wide by one micron deep grooves 50 between adjacent anode stripes 46. As a result, the increase in the path length between the anode stripes 46 for this illustrative embodiment is 2.6 times greater than the path length between the anode stripes 46 without any grooves.

In the present example, substrate 42 comprises borosilicate glass or quartz. A substrate 42 comprised of these materials will protect against moisture diffusion and sodium diffusion. $SiO_2$ insulating layer 44, which is typically provided by the manufacturer of substrate the 42, acts as a diffusion barrier. Also in the present example, conductive regions 46 comprise a plurality of parallel stripe conductors which extend normal to the plane of the drawing sheet. A suitable material for use as stripe conductors 46 may be indium-tinoxide (ITO), which is optically transparent and electrically conductive. In this example, luminescent material 48 comprises a particulate or thin-film phosphor coating which luminesces in one of the three primary colors, red ($\mathbf{48}_R$), green ($\mathbf{48}_G$) and blue ($\mathbf{48}_B$). A preferred process for applying phosphor coatings 48 to stripe conductors 46 comprises electrophoretic deposition.

By way of illustration, stripe conductors 46 may be 70 microns in width, and spaced from one another by 30 microns. The thickness of insulator 44 may be about 50 nm, the thickness of conductors 46 may be approximately 1.5 microns, and the thickness of phosphor coatings 48 may be approximately 5–10 microns. Substrate 42 is typically 1.1 mm thick. According to the present invention, the grooves 50 may be 1 micron wide with a pitch of 3 microns. However, grooves 50 having depths up to 10 microns below the surface of substrate 42 are within the scope of this invention.

Figure 3:
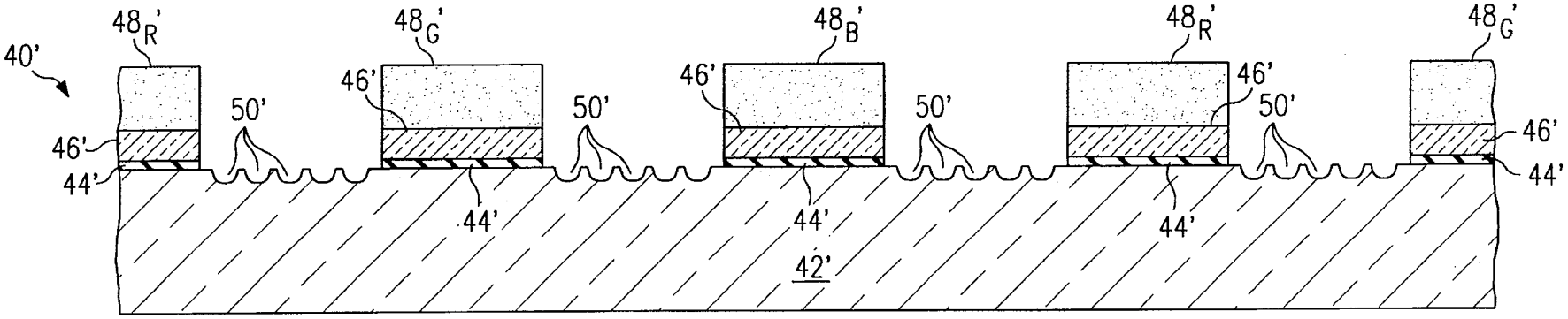
FIG. 3 is a cross-sectional view of an anode plate having undercut isolation grooves in accordance with a second embodiment of the present invention.

Referring now to FIG. 3, there is shown in cross-sectional view an anode plate 40' having undercut isolation grooves 50' in accordance with a second embodiment of the present invention. In FIG. 3 the elements which are similar in structure and which perform identical functions to those already described in relation to FIG. 2 are given the primed numerical designators of their counterparts.

In FIG. 3, anode plate 40' comprises a transparent planar substrate 42' having a layer 44' of an insulating material, illustratively silicon dioxide ($SiO_2$). The transparent planar substrate 42' is illustratively borosilicate glass or quartz. A plurality of electrically conductive regions 46' are patterned on insulating layer 44'. Luminescent material $48_R'$, $48_G'$ and $48_B'$ overlays conductors 46'. A plurality of grooves 50', having substantially curved sidewalls, are formed in the upper surface of planar substrate 42' at the interstices of conductors 46'. The grooves 50' of the anode plate 40' of the second embodiment is illustratively 3 microns wide with a pitch of 5 microns because the pitch must be increased for an isotropic etch. In addition, the grooves 50' are illustratively 2 microns deep, but may be up to 10 microns deep, below the surface of the substrate 42'.

Illustratively, there are four three micron wide by two micron deep grooves 50' between adjacent anode stripes 46'. As a result, the increase in the path length between the anode stripes 46' for this illustrative embodiment is 1.5 times greater than the path length between the anode stripes 46' without any grooves.

Figure 4:
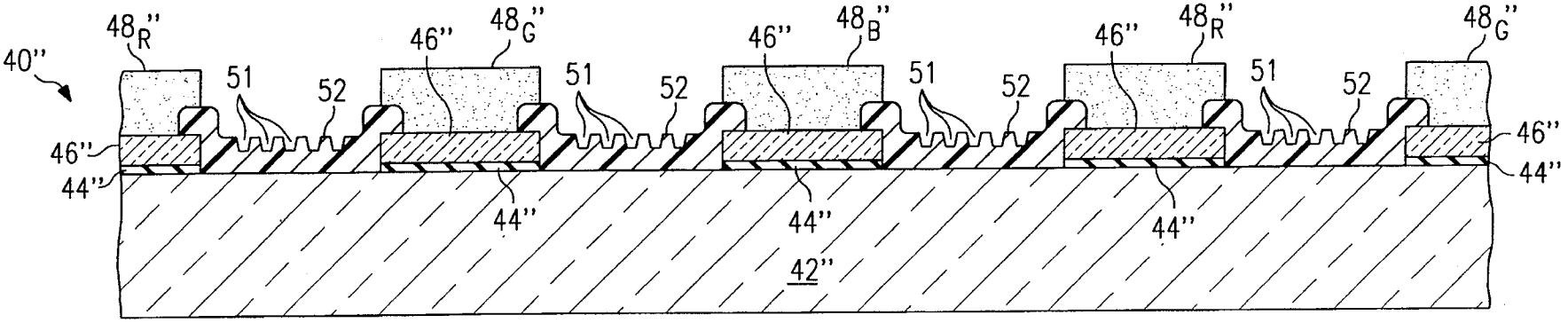
FIG. 4 is a cross-sectional view of an anode plate having isolation grooves in the insulator in accordance with a third embodiment of the present invention.

FIG. 4 shows, in cross-sectional view, an anode plate 40" having grooves 51 in accordance with a third embodiment of the present invention. The elements which are similar in structure and which perform identical functions to those already described in relation to FIGS. 2 and 3 are given the double primed numerical designators of their counterparts.

In FIG. 4, anode plate 40" comprises a transparent planar substrate 42", such as glass, having a layer 44" of an insulating material, illustratively silicon dioxide ($SiO_2$). A plurality of electrically conductive regions 46" are patterned on insulating layer 44". Luminescent material $48_R''$, $48_G''$ and $48_B''$ overlay conductors 46". An electrically insulating material 52 is formed in the upper surface of the substrate 42" between the conductive regions 46". The insulating material 52 is illustratively spin-on-glass (SOG), which is well known in the manufacture of, for example, liquid crystal displays. The thickness of SOG layer 52 may be approximately 1 micron.

A plurality of grooves 51, having substantially vertical sidewalls, are formed in the upper surface of the high voltage insulator 52. The grooves 51 are illustratively one micron wide with a pitch of two microns. In addition, the grooves 51 are illustratively from 0.3 to 0.9 microns below the surface of the insulator 52.

The path taken by electrons traveling between one high potential conductor 46" and an adjacent low potential conductor 46" during the high voltage breakdown is mainly along the top surface of the insulator 52. However, some voids will be present along the surface of the substrate 42" between the conductors 46". These voids may carry current during breakdown if there is poor bonding between the substrate 42" and the insulator 52. However, because electrons will flow more easily along the top surface of the insulator 52 than along the top surface of the substrate 42', the primary path for the high voltage breakdown is the top surface of the insulator 52. A variation within the scope of this embodiment is the addition of grooves into the top surface of the substrate 42", such as the grooves 50 shown in FIG. 2, for the purpose of preventing a high voltage path along the top surface of substrate 42" between adjacent conductors 46". This variation is discussed more fully below in relation to FIG. 20.

Illustratively, there are ten one micron wide by 0.5 micron deep grooves 50" between adjacent anode stripes 46". As a result, the increase in the path length between the anode stripes 46" for this illustrative embodiment is 1.3 times greater than the path length between the anode stripes 46" without any grooves.

Figure 5:
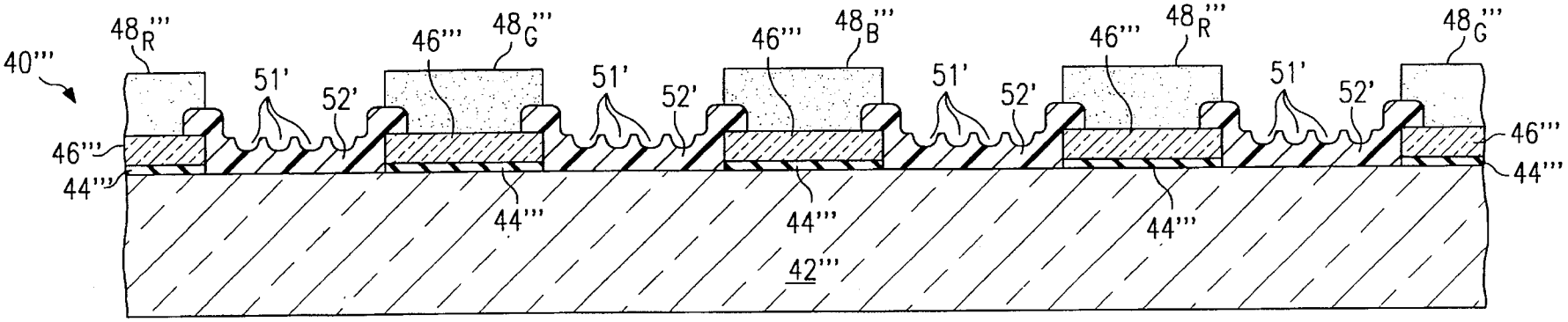
FIG. 5 is a cross-sectional view of an anode plate having undercut isolation grooves in the insulator in accordance with a fourth embodiment of the present invention.

Referring now to FIG. 5, there is shown in cross-sectional view an anode plate 40''' having undercut isolation grooves 51' in accordance with a fourth embodiment of the present invention. The elements which are similar in structure and which perform identical functions to those already described in relation to FIGS. 2, 3 and 4 are given the primed or triple primed numerical designators of their counterparts.

In FIG. 5, anode plate 40''' comprises a transparent planar substrate 42''' having a layer 44''' of an insulating material, illustratively silicon dioxide ($SiO_2$). A plurality of electrically conductive regions 46''' are patterned on insulating layer 44'''. Luminescent material $48_R'''$, $48_G'''$ and $48_B'''$ overlays conductors 46'''. An electrically insulating material 52' is formed in the upper surface of the substrate 42''' between the conductive regions 46'''. The insulating material 52' is illustratively spin-on-glass (SOG) of a thickness of approximately 1 micron.

A plurality of grooves 51', having substantially curved sidewalls, are formed in the upper surface of the high voltage insulator 52'. The grooves 51' are illustratively three microns wide with a pitch of five microns. In addition, the grooves 51' are illustratively from 0.3 to 0.9 microns below the surface of the insulator 52'. As a result, the increase in the path length between the anode stripes 46''' for this illustrative embodiment is 1.1 times greater than the path length between the anode stripes 46' without any grooves.

Figure 6:
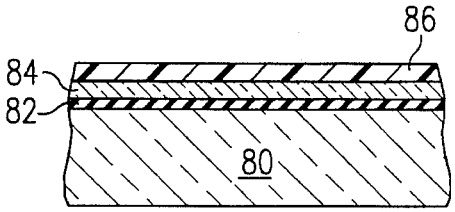
FIGS. 6 through 13 illustrate steps in a process for fabricating the anode plate of FIGS. 2 and 3 in accordance with the present invention.

One method of fabricating the anode plate shown in FIGS. 2 and 3 for use in a field emission flat panel display device, illustrating the principles of the present invention, comprises the following steps considered in relation to FIGS. 6 through 13. Referring initially to FIG. 6, a glass substrate 80 is coated with an insulating layer 82, typically $SiO_2$, which may be sputter deposited to a thickness of approximately 50 nm. A layer 84 of a transparent, electrically conductive material, typically indium-tin-oxide (ITO), is deposited on layer 82, illustratively by sputtering to a thickness of approximately 150 nm. A layer 86 of photoresist, illustratively type AZ-1350J sold by Hoescht-Celanese, of Somerville, N.J., is coated over layer 84, to a thickness of approximately 1000 nm.

Figure 7:
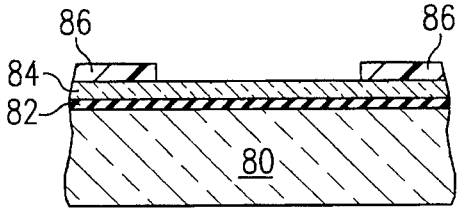
Figure 8:
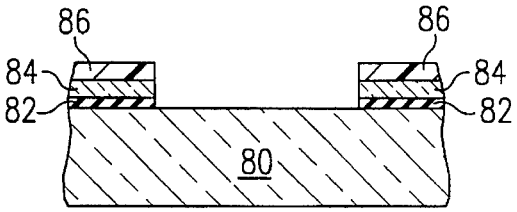

A patterned mask (not shown) is disposed over layer 86, exposing some regions of the photoresist. In the case of this illustrative positive photoresist, the exposed regions are removed during the developing step, which may comprise soaking the assembly in Hoescht-Celanese AZ-developer. The developer removes the unwanted photoresist, leaving photoresist layer 86 patterned as shown in FIG. 7. The exposed regions of ITO layer 84, as well as the associated underlying $SiO_2$ layer 82, are then removed, typically by a wet etch process, using as an illustrative etchant a solution of 6M hydrochloric acid (HCl) and 0.3M ferric chloride ($FeCl_3$) followed by a HF etch. The structure at the current stage of the fabrication process is shown in FIG. 8. The regions of ITO layer 84 which remain form the substantially parallel stripes across the surface of the anode plate.

Figure 9:
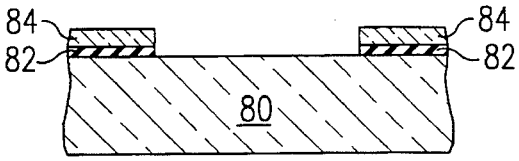

The remaining photoresist layer 86 may be removed by a wet strip process using commercial resist strippers; alternatively, layer 86 may be removed using a dry, oxygen plasma ash process. FIG. 9 illustrates the anode structure having patterned ITO regions 84 at the current stage of the fabrication process.

The next step in the process is to etch the grooves in the anode plate. Depending on the shape of the groove which is desired, this can be accomplished by two different means. If grooves with substantially vertical sidewalls are desired, as shown in the embodiment of FIG. 2, the glass substrate can be etched using an anisotropic etch such as RIE. If grooves with curved sidewalls are desired, as shown in the embodiment of FIG. 3, then an isotropic etch is used, such as plasma etch or wet etch.

Figure 10:
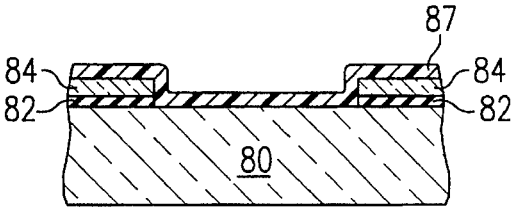
Figure 11:
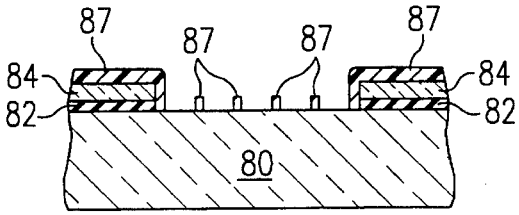

Before etching the grooves, a layer of positive photoresist 87, also illustratively type AZ-1350J sold by Hoescht-Celanese, of Somerville, N.J., is coated over the anode plate, as shown in FIG. 10, to a thickness of approximately 1000 nm. A patterned mask (not shown) is disposed over the photoresist 87 exposing regions of the photoresist. In the case of this illustrative positive photoresist, the exposed regions are removed during the developing step, which may comprise soaking the assembly in Hoescht-Celanese AZ-developer. The developer removes the unwanted photoresist, leaving photoresist layer 87 patterned as shown in FIG. 11.

Figure 12:
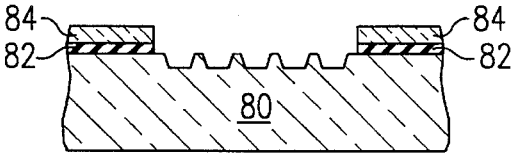
Figure 13:
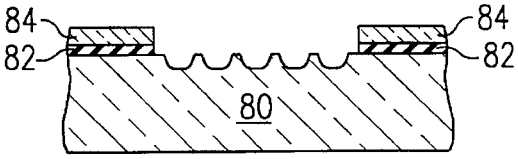

An anisotropic, or dry etch, of grooves having substantially vertical walls into the substrate 80, as shown in the embodiment of FIG. 2, may be accomplished using an etchant gas such as carbon tetrafluoride ($CF_4$) in an anisotropic RIE. If an isotropic etch which produces the substantially curved sidewalls shown in the embodiment of FIG. 3 is desired, a wet etch, such as hydrofluoric acid (HF) buffered with ammonium fluoride ($NH_4F$), may be used; or an unbiased plasma etch with $CF_4$. FIG. 12 illustrates the anode structure with a plurality of grooves having substantially vertical sidewalls created by the anisotropic etch. FIG. 13 illustrates the anode structure with a plurality of grooves having substantially curved sidewalls created by the isotropic etch.

Figure 14:
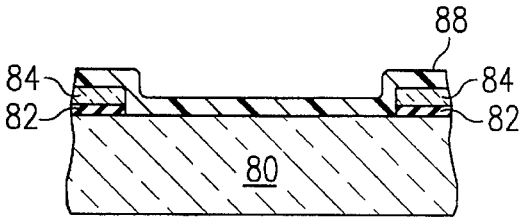
FIGS. 14 through 18 illustrate steps in a process for fabricating the anode plate of FIGS. 4 and 5 in accordance with the present invention.

A method of fabricating the anode plate shown in FIGS. 4 and 5 for use in a field emission display device incorporating the principles of the present invention, comprises the following steps, considered in relation to FIGS. 14 through 18. The first steps in the manufacturing process are the same as described above in relation to FIGS. 6 through 9. The next step in the fabrication process of the anode structure is to apply a coating 88 of spin-on-glass (SOG) over the anode plate structure, as shown in FIG. 14. The coating 88 is therefore applied over the striped regions of layer 84 and the exposed portions of substrate 80 and layer 82, typically to an average thickness of approximately 1 micron above the surface of substrate 80. However, a thicker or thinner SOG layer 88 is also comprehended by this invention. The method of application may comprise dispensing the SOG mixture onto the assembly while substrate 80 is being spun, thereby dispersing SOG coating 88 relatively uniformly over the anode surface and tending to accelerate the drying of the SOG solvent. Alternatively, the SOG mixture may be uniformly spread over a non-spinning anode surface using other dispensing techniques will known in the art.

Figure 15:
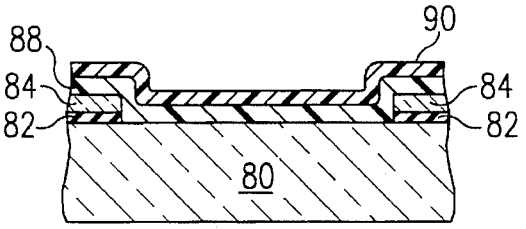

The SOG is then precured at 100° C. for about fifteen minutes, and then fully cured by heating it until virtually all of the solvent and organics have been driven off, typically at a temperature of 300° C. for approximately four hours. A coating 90 of positive photoresist, illustratively type AZ-1350J sold by Hoescht-Celanese, is deposited over the cured SOG, typically to a thickness of 1000 nm, as illustrated in FIG. 15.

Figure 16:
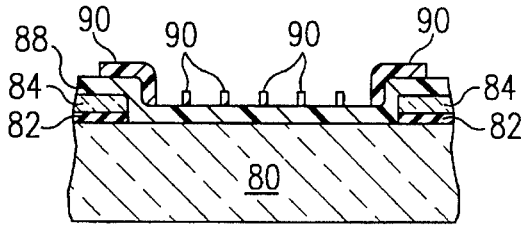
Figure 17:
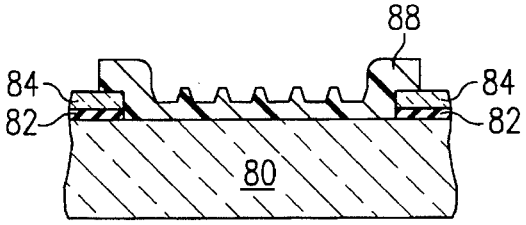
Figure 18:
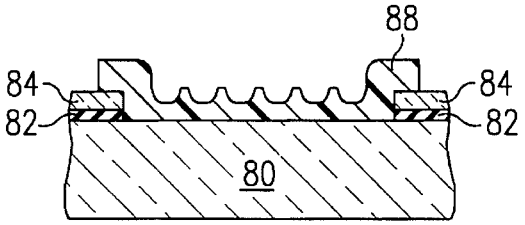

A second patterned mask (not shown) is disposed over layer 90 exposing regions of the photoresist which, in the case of this illustrative positive photoresist, are to be removed during the developing step: specifically those regions lying over selected portions of layer 88 located in the spaces between the anode stripes 84 and regions of anode stripe 84 to be coated with phosphor material. The photoresist is developed using AZ-developer, leaving photoresist layer 90 patterned as shown in FIG. 16.

The exposed regions of SOG layer 88 are then etched to the desired groove depths using an anisotropic oxide plasma etch process (RIE). Alternatively, the exposed regions of SOG layer 88 may be removed, by an isotropic wet etch process, using buffered hydrofluoric acid as an illustrative etchant; or by an isotropic plasma etch.

A second layer of resist is then added and patterned to expose anode stripe 84. A second etch is then used to completely remove the SOG over the anode stripes 84.

The remaining photoresist layers 90 may now be removed using a dry, oxygen plasma ash process. The anisotropic dry etch creates the anode structure having multiple vertical sidewall grooves in a glass insulating region 88 in the space between the patterned ITO stripes 84, shown in FIG. 17. The isotropic wet etch creates the anode structure having multiple curved sidewall grooves in a glass insulating region 88 in the space between the patterned ITO stripes 84, shown in FIG. 18.

The final steps in all of the fabrication processes of the anode structure discussed above is to provide the cathodoluminescent phosphor coatings 48 (of FIG. 2), which are deposited over conductive ITO regions 46, typically by electrophoretic deposition. The final structures are shown in FIGS. 2 through 5.

Figure 19:
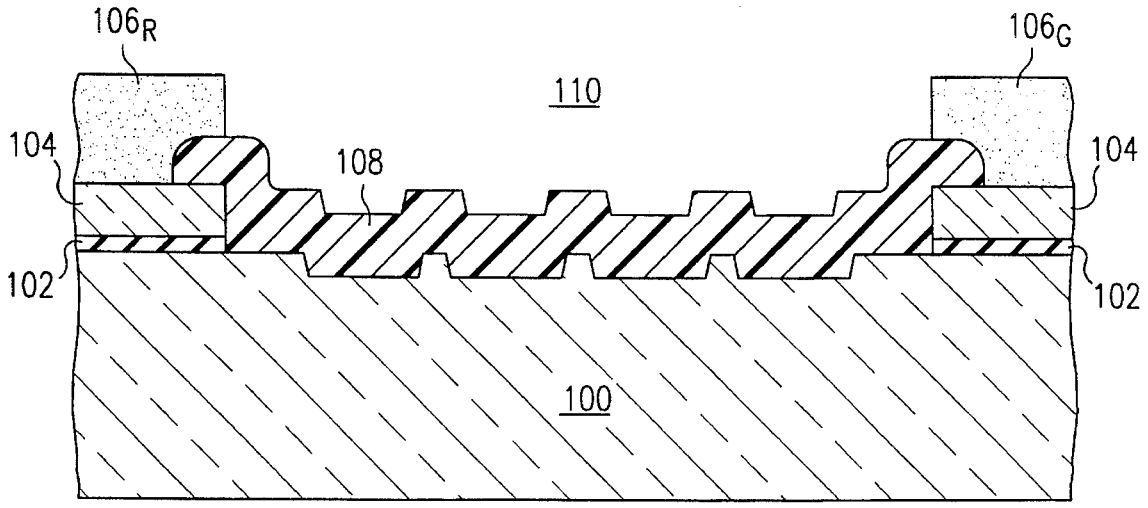
FIG. 19 is a cross-sectional view of an anode plate having an insulator and isolation grooves in the substrate in accordance with a fifth embodiment of the present invention.

Several other variations in the above processes, such as would be understood by one skilled in the art to which it pertains, are considered to be within the scope of the present invention. For example, as shown in FIG. 19, improved breakdown qualities may be realized by adding an insulator layer to the anode plate structure shown in FIGS. 2 and 3 and manufactured according to the discussion related to FIGS. 6 through 13. In FIG. 19, anode plate 110 comprises a transparent planar substrate 100 having a layer 102 of an insulating material, illustratively silicon dioxide ($SiO_2$). A plurality of electrically conductive regions 104 are patterned on insulating layer 102. Luminescent material $\mathbf{106}_R$, $\mathbf{106}_G$ and $\mathbf{106}_B$ (not shown) overlays conductors 104. An electrically insulating material 108 is formed in the upper surface of the anode plate between the conductive regions 104 after a plurality of grooves are formed in the anode plate 110 in accordance with the process discussed in relation to FIGS. 6 through 13. The grooves may have either substantially vertical or substantially curved sidewalls. The insulating material 108 is illustratively spin-on-glass (SOG) of a thickness of approximately 1 micron. Because the insulator layer 108 is formed on the grooved substrate surface 100, the insulator layer 108 is also slightly grooved, thereby increasing the creep path along the surface of the insulator 108.

Figure 20:
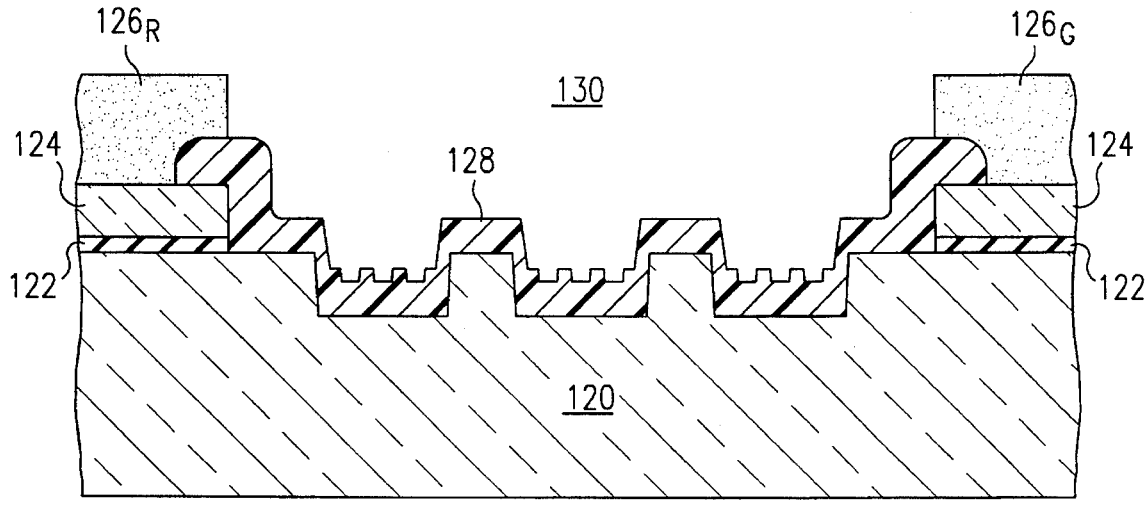
FIG. 20 is a cross-sectional view of an anode plate having isolation grooves in both the substrate and the insulator in accordance with a sixth embodiment of the present invention.

In yet another embodiment, shown in FIG. 20, improved breakdown qualities may be realized by forming grooves in both the insulator and the substrate. In FIG. 20, anode plate 130 comprises a transparent planar substrate 120 having a layer 122 of an insulating material, illustratively silicon dioxide ($SiO_2$). A plurality of electrically conductive regions 124 are patterned on insulating layer 122. Luminescent material $\mathbf{126}_R$, $\mathbf{126}_G$ and $\mathbf{126}_B$ (not shown) overlays conductors 124. An electrically insulating material 128 is formed in the upper surface of the anode plate between the conductive regions 124 after a plurality of grooves are formed in the anode plate 120 in accordance with the process discussed in relation to FIGS. 6 through 13. Then a plurality of grooves are formed in the insulating material in accordance with the process discussed in relation to FIGS. 14 through 18. All of the grooves may have either substantially vertical or substantially curved sidewalls. The insulating material 108 is illustratively spin-on-glass (SOG) of a thickness of approximately 1 micron. The grooves are illustratively from 0.3 to 0.9 microns below the surface of the insulator 128. However, grooves which are between 0.3 to 10 microns are within the scope of this invention. Of course, grooves which are deeper than the thickness of insulator 128 will extend through the insulator layer 128 into the substrate 120, thereby breaking the continuity of the insulator layer. The structure shown in FIG. 20 also improves breakdown qualities of anode plate 0 by increasing the creep path between the anode stripes 124.

Still other variations in the above processes, such as would be understood by one skilled in the art to which it pertains, are considered to be within the scope of the present invention. As a first such variation, it will be understood that insulating layer 88 may be deposited by a technique other than those described above, for example, chemical vapor deposition or sputter deposition. Furthermore, while the disclosure describes a 1000 nm thick SOG layer 88, a thinner layer of insulator may be used. For example a 10 nm thick insulator layer having numerous shallow grooves is also comprehended by this invention.

According to another variation, the grooves may be formed mechanically on the transparent substrate starting material; for example through polishing. Alternatively, the grooves may be formed thermo-mechanically. For example, by heating the substrate and pressing a patterned plate against the heated substrate, the desired pattern (such as a saw-tooth pattern) is transferred to the substrate surface. In addition, the grooves may be formed earlier in the manufacturing process; for example, before depositing the $SiO_2$ and anode stripe layers.

According to yet another variation, SOG layer 88 may be dry etched, illustratively in a plasma reactor. It will also be recognized that a hard mask, such as aluminum or gold, may replace photoresist layers 86, 87, and 90 of the above processes. Finally, photosensitive glass materials are known, and it may be possible to pattern insulator layer 88 directly, without the use of photoresists.

A field emission flat panel display device, as disclosed herein, having an anode plate with multiple grooves in the substrate and/or insulator in the spaces between the conductive regions, and the methods disclosed herein for fabricating such anode plate, overcome limitations and disadvantages of the prior art display devices and methods. Specifically, the multiplicity of grooves, which are formed between adjacent stripe conductors, enhance the electrical isolation between the adjacent conductors by increasing the path length. This increase in the electrical isolation of the stripe conductors from one another allows higher anode potentials to be used during anode operation without the risk of panel failure from high voltage breakdown. The result of the teachings of the present invention is that the FED can operate reliability at an increased anode voltage level and therefore operate successfully at an increased luminance.

Finally, it is noted that the improved breakdown qualities of the anode plate of the present invention will allow the use of narrower spacings between high potential stripe conductors of the anode, thereby allowing increased image resolution. Hence, for flat panel display device applications, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating an anode plate for use in a field emission display device, said method comprising the steps of:

providing a substantially transparent substrate having spaced-apart, electrically conductive regions on a surface thereof;

etching a plurality of grooves in said surface in the spaces between said electrically conductive regions; and applying luminescent material on said conductive regions.

2. The method in accordance with claim 1 wherein said step of etching grooves in said surface in the spaces between said electrically conductive regions comprises selectively etching said surface to a depth up to 10 μmeters.

3. The method in accordance with claim 1 wherein said step of etching grooves in said surface in the spaces between said electrically conductive regions comprises dry etching said surface using carbon tetrafluoride ($CF_4$) as an etchant.

4. The method in accordance with claim 1 wherein said step of etching grooves in said surface in the spaces between said electrically conductive regions comprises wet etching said surface using buffered hydrofluoric acid as an etchant.

5. The method in accordance with claim 1 wherein said step of applying luminescent material on said conductive regions comprises electrophoretic deposition.

6. The method in accordance with claim 1 further including the step of:

applying an electrically insulating material in said spaces between said electrically conductive regions; and etching a plurality of grooves in a surface of said insulating material.

7. The method in accordance with claim 6 wherein said step of etching grooves in said insulator surface in the spaces between said electrically conductive regions comprises selectively etching said insulator surface to a depth up to 10 μmeters.

8. The method in accordance with claim 6 wherein said step of etching grooves in said insulator surface in the spaces between said electrically conductive regions comprises dry etching said insulator surface using carbon tetrafluoride ($CF_4$) as an etchant.

9. The method in accordance with claim 6 wherein said step of etching grooves in said insulator surface in the spaces between said electrically conductive regions comprises wet etching said insulator surface using buffered hydrofluoric acid as an etchant.

10. A method of fabricating an anode plate for use in a field emission device, said method comprising the steps of:

providing a substantially transparent substrate having spaced-apart, electrically conductive regions on a surface thereof;

applying luminescent material on said conductive regions applying an electrically insulating material in said spaces between said electrically conductive regions; and etching a plurality of grooves in a surface of said insulating material.

11. The method in accordance with claim 10 wherein said step of etching grooves in said insulator surface in the spaces between said electrically conductive regions comprises 'selectively etching said insulator surface to a depth up to 10 μmeters.

12. The method in accordance with claim 10 wherein said step of etching grooves in said insulator surface in the spaces between said electrically conductive regions comprises dry etching said insulator surface using carbon tetrafluoride ($CF_4$) as an etchant.

13. The method in accordance with claim 10 wherein said step of etching grooves in said insulator surface in the spaces between said electrically conductive regions comprises wet etching said insulator surface using buffered hydrofluoric acid as an etchant.

14. The method in accordance with claim 10 wherein said step of applying luminescent material on said conductive regions comprises electrophoretic deposition.

15. A method of fabricating an anode plate for use in a field emission display device, said method comprising the steps of:

providing a substantially transparent substrate;

depositing a layer of a transparent, electrically conductive material on a surface of said substrate;

removing portions of said layer of conductive material to leave substantially parallel stripes of said conductive material;

applying luminescent material on said conductive regions;

coating said surface with a solution of an electrically insulating material;

removing said insulating material from areas overlaying said conductive regions; and etching exposed regions of said insulator material to form a plurality of grooves therein.

16. The method in accordance with claim 15 wherein said step of etching said exposed region of said insulator includes selectively etching said substrate to a depth up to 10 μmeters.

17. The method in accordance with claim 15 wherein said step of etching said exposed region of said insulator comprises dry etching said surface using carbon tetrafluoride ($CF_4$) as an etchant.

18. The method in accordance with claim 15 wherein said step of etching said exposed region of said insulator comprises wet etching said surface using buffered hydrofluoric acid as an etchant.

19. The method in accordance with claim 15 wherein said step of applying luminescent material on said conductive regions comprises electrophoretic deposition.

20. The method in accordance with claim 15 wherein said step of removing portions of said layer of conductive material comprises the sub-steps of:

coating said surface with a layer of photoresist;

masking said photoresist layer to expose regions corresponding to said substantially parallel stripes;

developing said exposed regions of said photoresist layer;

removing the developed regions of said photoresist layer to expose regions of said layer of conductive material;

removing said exposed regions of said layer of conductive material; and removing the remaining regions of said photoresist layer.

21. The method in accordance with claim 20 wherein said step of removing said exposed regions of said layer of conductive material comprises wet etching said conductive material with a solution of hydrochloric acid and ferric chloride.

22. The method in accordance with claim 15 wherein said step of removing said cured insulator material from areas overlaying said conductive regions comprises the sub-steps of:

coating said insulator material with a first layer of photoresist;

masking said first photoresist layer to expose regions corresponding to selected regions of spaces between said substantially parallel stripes and said substantially parallel stripes;

developing said exposed regions of said first photoresist layer;

removing the developed regions of said first photoresist layer to expose regions of said layer of cured insulator material;

removing said exposed regions of said layer of cured material; and coating said insulator material with a second layer of photoresist;

masking said second photoresist layer to expose regions corresponding to said substantially parallel stripes;

developing said exposed regions of said second photoresist layer;

removing the developed regions of said second photoresist layer to expose regions of said layer of cured insulator material;

removing said exposed regions of said layer of cured material; and removing the remaining regions of said first and second photoresist layers.

23. The method in accordance with claim 22 wherein said step of removing said exposed regions of said layer of cured insulator material comprises wet etching said conductive material with a solution of buffered hydrofluoric acid.

24. A method of fabricating an anode plate for use in a field emission display device, said method comprising the steps of:

providing a substantially transparent substrate;

depositing a layer of a transparent, electrically conductive material on a surface of said substrate;

removing portions of said layer of conductive material to leave substantially parallel stripes of said conductive material;

etching exposed regions of said substrate to form a plurality of grooves therein; and applying luminescent material on said conductive regions.

25. The method in accordance with claim 24 wherein said step of removing portions of said layer of conductive material comprises the sub-steps of:

coating said surface with a layer of photoresist;

masking said photoresist layer to expose regions corresponding to said substantially parallel stripes;

developing said exposed regions of said photoresist layer;

removing the undeveloped regions of said photoresist layer to expose regions of said layer of conductive material; and removing said exposed regions of said layer of conductive material.

26. The method in accordance with claim 25 wherein said step of removing said exposed regions of said layer of conductive material comprises wet etching said conductive material with a solution of hydrochloric acid and ferric chloride.

27. The method in accordance with claim 24 wherein said step of etching said exposed region of said substrate comprises wet etching said surface using buffered hydrofluoric acid as an etchant.

28. The method in accordance with claim 24 wherein said step of applying luminescent material on said conductive regions comprises electrophoretic deposition.

29. The method in accordance with claim 24 wherein said step of etching said exposed region of said substrate includes selectively etching said substrate to a depth up to 10 μmeters.

30. The method in accordance with claim 24 wherein said step of etching said exposed region of said substrate comprises dry etching said surface using carbon tetrafluoride ($CF_4$) as an etchant.

* * * * *